US006852457B2

(12) United States Patent
Katagiri et al.

(10) Patent No.: US 6,852,457 B2
(45) Date of Patent: Feb. 8, 2005

(54) IMAGE FIXING METHOD

(75) Inventors: Yoshimichi Katagiri, Kawasaki (JP); Yasushige Nakamura, Kawasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 57 days.

(21) Appl. No.: 10/291,378

(22) Filed: Nov. 12, 2002

(65) Prior Publication Data

US 2003/0186143 A1 Oct. 2, 2003

(30) Foreign Application Priority Data

Mar. 29, 2002 (JP) ..... 2002-097183

(51) Int. Cl.[7] ..... G03G 9/08
(52) U.S. Cl. ..... 430/45; 430/47; 430/124
(58) Field of Search ..... 430/45, 47, 124

(56) References Cited

U.S. PATENT DOCUMENTS 2,297,691 A 10/1942 Carlson
6,555,280 B2 * 4/2003 Horikoshi et al. ..... 430/124
6,593,050 B2 7/2003 Katagiri et al. ..... 430/108.23

FOREIGN PATENT DOCUMENTS

| | | |
|---|---|---|
| JP | 61-132959 | 6/1986 |
| JP | 6-118694 | 4/1994 |
| JP | 06-348056 | 12/1994 |
| JP | 7-191492 | 7/1995 |
| JP | 2000-147824 | 5/2000 |

* cited by examiner

*Primary Examiner*—Mark A. Chapman
(74) *Attorney, Agent, or Firm*—Westerman, Hattori, Daniels & Adrian, LLP

(57) ABSTRACT

The "sequential developments and one-time fixing" method of the present invention specifies that a toner having the greatest PAS strength value should be placed on the top of a lamination of toner layers, which provides efficient radiant energy absorption by the whole lamination of the toner layers, allows efficient heat transmission from the top layer to lower layers, and provides satisfactory color image fixing at relatively low flashing light irradiation energy.

3 Claims, 2 Drawing Sheets

Table 1:

| Required energy J/cm$_2$ | Toner set | |
|---|---|---|
| | Group a c e g | Group b e f g |
| 2.8 | | KCMY, KMYC, KCYM, KYCM, KMCY, KYMC |
| 2.9 | KCMY, KMYC, KCYM, KYCM, KMCY, KYMC | |
| 3.0 | | |
| 3.1 | | CKMY, CKYM |
| 3.2 | | CMKY, MKCY, CMYK, MKYC, CYKM, MCKY, CYMK, YKMC |
| 3.3 | CKMY, CKYM | MCYK, YCKM, MYKC, YCMK, MYCK, YMKC, YKCM, YMCK |
| 3.4 | MKCY, YKCM, MKYC, YKMC | |
| 3.5 | CMKY, MCYK, CMYK, MYKC, CYKM, MYCK, CYMK, YCKM, MCKY | |
| 3.6 | YCMK, YMCK, YMKC | |

Y: yellow, M: magenta, C: cyan, K: black

FIG.1

Table 1:

| Required energy $J/cm_2$ | Toner set | |
|---|---|---|
| | Group a c e g | Group b e f g |
| 2.8 | | KCMY, KMYC, KCYM, KYCM, KMCY, KYMC |
| 2.9 | KCMY, KMYC, KCYM, KYCM, KMCY, KYMC | |
| 3.0 | | |
| 3.1 | | CKMY, CKYM |
| 3.2 | | CMKY, MKCY, CMYK, MKYC, CYKM, MCKY, CYMK, YKMC |
| 3.3 | CKMY, CKYM | MCYK, YCKM, MYKC, YCMK, MYCK, YMKC, YKCM, YMCK |
| 3.4 | MKCY, YKCM, MKYC, YKMC | |
| 3.5 | CMKY, MCYK, CMYK, MYKC, CYKM, MYCK, CYMK, YCKM, MCKY | |
| 3.6 | YCMK, YMCK, YMKC | |

Y: yellow, M: magenta, C: cyan, K: black

FIG. 2

Table 2:

| Required energy $J/cm_2$ | Toner set | |
|---|---|---|
| | Group a c e | Group b e f |
| 2.8 | | CMY |
| 2.9 | | CYM, MYC, MCY, YCM |
| 3.0 | | YMC |
| 3.1 | CMY, MCY, CYM | |
| 3.2 | MYC, YMC, YCM | |

Y: yellow, M: magenta, C: cyan

IMAGE FIXING METHOD

BACKGROUND OF THE INVENTION

1. Field of the Invention

The present invention generally relates to an image formation method that uses electrophotography, iono-graphy, and magneto-graphy, and the like, and especially relates to the image formation method wherein a plurality of toners are laminated by developments, and then, all the laminated toners are fixed in one operation that employs radiant energy of a flashlight.

2. Description of the Related Art

Electrophotography is widely used in image formation apparatuses, such as copying machines, facsimile machines, and printers. Electrophotography often employs a method that uses an optically conductive insulator, as indicted by U.S. Pat. No. 2,297,691, etc. In this method, an electrostatic latent image is formed by irradiating light from a luminous source, such as a laser and a LED, to the optically conductive insulator that is electrified by a corona electric discharge, or by an electrically charging roller. Then, resin powder colored by pigments and dyes (hereinafter called colorant), which is called toner, is adhered to the latent image by an electrostatic force, and the latent image becomes a visible toner image. Then, the toner image is transferred to a recording medium, such as paper and film. However, the toner image at this stage is only an image of powder that is simply placed on the recording medium. The powder needs to be fixed on the recording medium. For this purpose, the toner is fused on the recording medium by heat, pressure, light, etc., and then the toner solidifies. In this manner, the toner image is finally fixed to the recording medium.

As described above, fixing of the toner usually refers to fusing the toner that is powder mainly consisting of thermoplastic resin (called binder resin hereinafter) by heat, and then, adhering the toner to a recording medium. Well-known fixing methods include a heat roll method, wherein a roller applies heat and pressure directly to the recording medium on which the toner image is formed. Another well-known method is a flashlight fixing method wherein the toner is fixed on the recording medium by irradiating flashing light of a lamp such as a xenon flash lamp.

The flashlight fixing method transforms radiant energy of sparkling light (flashlight) from a discharge tube, such as the xenon flash lamp, into thermal energy, which is used to fuse the toner. Then, the toner is fixed to the recording medium The flashlight fixing method when used in the image formation apparatus has the following features, as compared with the heat roll method.

(1) Fixing is performed without contacting the toner image, therefore, resolution of the toner image formed on the optically conductive insulator is not degraded.

(2) The flashlight fixing does not require any warming up at starting, providing a quick start for an operation.

(3) The flashlight fixing is not excessively sensitive to material and thickness of the recording medium, whether it is paper with adhesive, pre-printed paper, variable thickness paper, and the like.

A process in which the toner is fixed on the recording medium by the flashlight fixing is as follows. The radiant energy of the flashing light emitted from the discharge tube is absorbed by the toner image (powder image) that is formed on the recording medium, and is converted into thermal energy. Thereby, the temperature of the toner rises, the toner is softened and fused, and is stuck to the recording medium. When the flashing light is turned off, the temperature falls, and the fused toner solidifies and is fixed to the recording medium, producing the fixed toner image.

However, a xenon flash lamp that is usually employed as the discharge tube for the flashlight fixing emits light over a wide range of wavelengths such as between 400 nm and 1400 nm. The luminous intensity of the xenon flash lamp is considerably higher in a range of 800 nm–1400 nm, which is in the near-infrared wavelength domain, compared with the luminous intensity in the visible wavelength range, i.e., 400 nm–800 nm. For this reason, the toner used in the flashlight fixing is required to have high radiant energy absorption properties in the wavelength range of 800 nm–1400 nm, that is, the near-infrared wavelength domain.

However, generally the binder resin that is one of two main ingredients of the toner has a remarkably low radiant energy absorption nature in the visible and the near-infrared wavelength domains. As for the second ingredient, that is, the colorant, black colorant shows a high radiant energy absorption property in both the visible and the near-infrared domains. However, colorants of different colors, such as yellow, cyan, magenta, red, blue, and green, show a high radiant energy absorption property in the visible wavelength domain, but have a low radiant energy absorption property in the near-infrared domain.

For this reason, color toner containing the binder resin and the colorant for colors requires a higher intensity of the flashing light to fix an image than required by the black toner.

To solve the problem as mentioned above, it has been proposed that an infrared light absorbent material that absorbs the radiant energy in the luminous wavelength range of the xenon flash lamp be added to the colorants in order to reduce the amount of radiant energy required for fixing the color toner on the recording medium by the flashing light. For example, in JP S61-132959A, JP H06-118694A, JP H07-191492A, and JP 2000-147824A, disclosures have been made about adding materials to the toner for the flashlight fixing, the materials being an aminium system compound, a dimonium system compound, and a naphthalo-cyanine system compound. Moreover, JP H06-348056A discloses a technology of adhering resin granules to the surface of the toner, the resin granules containing an infrared light absorbing material such as an anthraquinone system, a polymethine system, and a cyanine system. Furthermore, a technology of improving the fixing properties of the color toner in the flashlight method has been published by JP H10-39535A, in which tin oxide and indium oxide are added to the color toner.

The technologies indicated above attempt to improve efficiency in converting energy from radiant energy to thermal energy. For this purpose, the infrared light absorbent is added to the color toner such that the fusion property of the binder resin, which is the main ingredient, is enhanced.

However, the conventional technologies, which, in essence, simply add the infrared light absorbent, have not solved all the problems described above. Specifically, adding a small amount of the infrared light absorbent material does not sufficiently improve the fusion properties of the binder resin. However, the materials that are added to enhance infrared absorption, namely, the aminium system compound, the dimonium system compound, and the naphthalo-cyanine system compounds are colored by nature. That is, if a large amount of these materials is used, chroma and hue of a color image is adversely affected. Therefore, it is desired that the amount of the infrared light absorbent be as small as possible.

As mentioned above, the flashlight method of the conventional technology still requires a large amount of radiant energy in order to firmly fix the color toner.

The above problem of needing the large amount of radiant energy becomes a bigger problem in multi-color and full-color image formation, when a "sequential developments and one-time fixing" method is used, wherein a plurality of toner powder image layers are laminated, and then the laminated layers are fixed by one shot.

In the "sequential developments and one-time fixing" method, greater radiant energy is required in order to firmly fix the toner of the laminated layers compared to fixing a single toner layer. In addition, even if the radiant energy is simply increased for fixing the laminated layer, it is difficult to obtain firm toner fixing. It is because not only the total amount of the toner to be fused by irradiation of light is large, but also the flashing light is absorbed by upper toner layers, and lower layers that are closer to the recording medium, and therefore, more relevant to the fixing properties, do not receive sufficient energy for fusing.

For the above reason, energy from irradiation of more than two times is required of conventional color printers adopting the "sequential developments and one-time fixing" method, in comparison with radiant energy of monochrome printers of the same speed. In order to provide irradiation of such high energy, a large-scale irradiation unit is required.

Therefore, a problem is that an image formation apparatus tends to be large-sized, expensive, and the radiant energy absorption efficiency therein falls, being incapable of meeting recent requirements for higher speed in forming an image.

The present invention is made in view of the above problem. Therefore, the purpose of the present invention is to offer a "sequential developments and one-time fixing" method that provides a high-quality fixed image using less radiant energy.

The toner used in the electrophotography of the present invention can be properly used in other image formation methods such as iono-graphy and magneto-graphy.

SUMMARY OF THE INVENTION

It is a general object of the present invention to provide an image formation method that substantially obviates one or more of the problems caused by the limitations and disadvantages of the related art.

Features and advantages of the present invention will be set forth in the description that follows, and in part will become apparent from the description and the accompanying drawings, or may be learned by practice of the invention according to the teachings provided in the description. Objects as well as other features and advantages of the present invention will be realized and attained by the image formation method particularly pointed out in the specification in such full, clear, concise, and exact terms as to enable a person having ordinary skill in the art to practice the invention.

To achieve these and other advantages and in accordance with the purpose of the present invention, as embodied and broadly described herein, the present invention provides the image fixing method as follows.

In the "sequential developments and one-time fixing" method of the present invention, a plurality of toners, called n toners, each toner providing a color different from others, are layered on a recording medium by repeating developments for n times. The toner layers are named a first layer through an n-th layer, the first layer being the bottom layer that is immediately above the recording medium, and the n-th layer being the top layer that is the closest to the luminous source of the flashlight. The toner layers are laminated, and flashing light is applied to the laminated toner layers such that the laminated toner layers are fixed, forming a color image.

The object of the present invention is achieved by setting a PAS (photo acoustic spectroscopy) strength value of the toner of the n-th layer greater than a PAS strength value of the toner of any other layers.

When the laminated toner layers are fused for fixing, especially in the case of a full color image formation, it is desired that all the toner layers be fused simultaneously, and the toner layers be mixed uniformly such that color reproducibility over a wide range is obtained.

However, as described above, upper layers absorb the flashing light, and the flashing light is attenuated when arriving at lower layers. In order for all the toner layers to be simultaneously fused, high irradiation energy of 3 to 4 times or more of the irradiation energy used by a monochrome image formation apparatus of the same speed is required. Further, highly delicate adjustments in properties, such as radiant energy absorption properties, and fusion viscosity and elasticity, are required for various toners that constitute the toner layer.

According to findings by the inventors of the present invention, et al., an image formation with a practically acceptable color reproduction capability is obtained by setting up the PAS strength value of the toner forming the n-th layer, which is located closest to the luminous source, higher than the PAS strength value of the toner forming any other layer, when forming the laminated toner layer consisting of the first layer at the bottom and immediately above the recording medium through the n-th layer. This configuration can be built simply and economically.

The inventors of the present invention et al. assume the reason why the above configuration achieves the objective is because heat converted from the radiant energy by the n-th layer is efficiently transmitted through the layers, fusing the toner layers. That is, by arranging the toner layer that has the best radiant-thermal conversion properties at the top of the laminated layers, the radiant energy absorption efficiency of the whole set of toner layers is increased, and heat stored by the upper layers is transmitted to the lower layers. In this manner, the lower layers, receiving lower irradiation energy, can be fused sufficiently by the additional heat transmitted as described above.

PAS mentioned in the present invention refers to photo acoustic spectroscopy, which is a method to detect a periodic thermal change occurring in a sample due to irradiated flashing light, as a pressure change. The method provides an in-situ measurement.

A further description of the PAS analyzing method used by the present invention is explained as follows. Modulated infrared light is irradiated to the sample, and the light (radiant energy) is absorbed by the sample, then the irradiated light generates heat. The heat causes a pressure change in the surrounding atmosphere, and a high sensitivity microphone detects the pressure change. By applying a Fourier transformation, an infrared PAS spectrum that is similar to an ordinary infrared absorption spectrum is obtained.

The present invention uses measuring results by the PAS analyzing method, wherein a PAS strength value of the toner is defined by integrating the infrared PAS spectrum obtained by the PAS analyzing method in a wavelength range of, e.g., 800 nm–2000 nm.

As above, according to the present invention, firm fixing of the laminated layer is realized by the top layer efficiently absorbing the radiant energy, fusing itself, and providing heat to the lower layers.

In addition, the image formation method of the present invention specifies that relations between a PAS strength value of any of the toner layers $S_x$ and a PAS strength value of a layer immediately below $S_{x-1}$ are desired to satisfy a formula (1) below, where n=>x>1.

$$S_{x-1} <= S_x \quad (1)$$

Further, according to the present invention, it is recommended that the topmost layer, the n-th layer, be a black toner.

The inventors of the present invention et al. have determined that if the layers are laid in the sequence of the PAS strength value, with an upper layer having a greater PAS strength value than a lower layer, the object of the present invention is easier to attain.

This is because heat energy absorbed by the upper layers is efficiently transmitted to the lower layers in the above configuration, requiring relatively low irradiation power.

Furthermore, the inventors of the present invention et al. have determined that if a black toner is included, arranging the black toner as the top layer attains the objective of the present invention easily.

In this manner, according to the present invention, thermal energy converted from the radiant energy of the flashlight by the upper toner layers is efficiently transmitted to the lower toner layers, realizing the one-time fixing with relatively low irradiation power.

According to the present invention, the laminated toner layers containing one or more color toner layers can be fixed with a relatively low amount of irradiation energy, which is less than double of the irradiation light energy used in a monochrome image formation apparatus of the same speed.

The color toner used in the image formation method of the present invention contains at least a binder resin, a colorant, and an infrared light absorbent. The PAS strength value of the color toner is desired to range between 0.01 and 0.2, when the PAS strength value of black carbon is set at 1. Here, the PAS strength value is an integral value of the infrared PAS spectrum obtained from the PAS analyzing method in the wavelength range between 800 nm and 2000 nm.

Further, it is more desirable that the PAS strength value of the color toner ranges between 0.2 and 0.9 times the PAS strength value of the black toner that is simultaneously fixed, and between 0.2 and 5 times the PAS strength value of toner of other colors simultaneously fixed.

Under the conditions such as above, the image formation method that fixes the laminated layers provides best results, using the irradiated energy efficiently.

The reason why the integration is performed in the wavelength range of 800 nm–2000 nm is because the xenon flash lamp emits the strongest irradiation in the range mentioned above, therefore, the range is the governing range in controlling the radiant energy absorption/fusion properties of the toner.

The present invention is related to a previous invention, for which the inventors of the present invention have filed application for patent No. 2001-102439. The previous invention uses measurement results by the PAS analyzing method, based on findings that color toner having the PAS strength value in a range of 0.01–0.2 provides an excellent fixing, where the value of the PAS strength value is an integral value of the infrared PAS spectrum obtained by the PAS analyzing method in the wavelength range of 800–2000 nm, and the PAS strength value of carbon black is set to 1. Such color toner realizes image fixing with a low radiant energy equivalent to the energy of the flashlight for image fixing of only black toner.

When the PAS strength value is less than 0.01, sufficient fixing is not obtained because radiant energy absorption in the infrared domain of the color toner is too low, with radiant-thermal conversion efficiency being too low. If, on the other hand, the PAS strength is greater than 0.2, sufficient fixing is obtained. However, in order to make the PAS strength greater, a large amount of an infrared light absorbent will be required, which adversely affects chroma, and the like, of a color image after fixing, as mentioned above.

Moreover, it is described that it is desirable to configure such that the PAS strength value of the color toner for the flashlight fixing is set to between 0.2 and 0.9 times the PAS strength value of the black toner that is fixed simultaneously.

If the toners in various colors are configured in this manner, the color toner that is fixed simultaneously with the black toner on the recording medium of the image formation apparatus is satisfactorily fixed. In other words, fixing properties of the color toner and the black toner can be made into an equivalent level by setting the difference between the PAS strength value of the color toner and the PAS strength value of the black toner to fall in the predetermined range.

In the case that the PAS strength value of the color toner is less than 0.2 times the black toner, and the flashlight fixing is carried out with energy that gives a satisfactory fixing result to the black toner, fixing of the color toner becomes poor. Conversely, if the flashlight fixing is carried out with energy that gives the color toner a satisfactory fixing result, a void will be generated in the black toner because the energy of the flashlight is excessive for the black toner, and excessive fusing occurs, resulting in poor image quality. Thus, when the PAS strength value of the color toner is less than 0.2 times the black toner, it is difficult to obtain good fixing results for both the color toner and the black toner simultaneously.

On the other hand, if the PAS strength value of the color toner is greater than 0.9 times the black toner, a satisfactory fixing result is available for both the black toner and the color toner. However, the high PAS strength value of the color toner means that a large amount of the infrared light absorbent is added, which causes an adverse influence on the chroma of the color image.

Further, in the previous invention, it is described that the PAS strength value of a color toner is desired to be set to 0.2 to 5 times the PAS strength value of toner of other colors that are to be fixed simultaneously.

In this manner, two or more colors can be simultaneously fixed on the recording medium with satisfactory quality. In other words, fixing properties of all the color toners, each toner being for one color, can be made into an equivalent level by mutually setting the difference of the PAS strength value of the color toner in each color to fall in the predetermined range.

Here, when the PAS strength value of a first color toner is less than 0.2 times a second color toner, and flashlight fixing is carried out with energy that gives a satisfactory fixing result for the second toner, the fixing of the first toner become poor. Conversely, if the flashlight fixing is carried out with energy that gives a satisfactory fixing result for the first color toner, a void will occur in the second color toner, because the energy of the flashlight is excessive for the second color toner, resulting in excessive fusing, and therefore, poor image quality. Thus, when the PAS strength value of the first color toner is less than 0.2 times the second color toner, or vice versa, it is difficult to obtain a satisfactory fixing result. Similarly, if the PAS strength value of the first color toner is greater than 5 times the second color toner, or vice versa, it is impossible to give a satisfactory fixing result to both the colors simultaneously.

Moreover, the color toner for the flashlight fixing may contain two or more infrared light absorbents that have different absorption wavelength ranges within the wavelength range between 800 nm and 2000 nm.

For the color toner that contains two or more infrared light absorbents, each absorbent having a different absorption spectrum, absorption efficiency in the 800–2000 nm wavelength range is enhanced, resulting in a higher PAS strength value, further resulting in a satisfactory fixing of an image. An infrared absorbent typically has one absorption peak in a specific wavelength range. Increasing an amount of only one kind of the infrared absorbent that absorbs only a part of the 800–2000 nm range is not an efficient method. What is worse is that the increased amount of the infrared absorbent deteriorates the chroma of the image, and the like, as discussed above. The color toner, according to the present invention, containing two or more infrared absorbents that have absorption peaks in different areas within the 800–2000 nm range realizes a higher efficiency in using the energy irradiated, while alleviating the image quality deterioration caused by using a large amount of one absorbent.

The infrared light absorbent of the present invention mentioned above can contain, for example, a first infrared light absorbent (A) that has an absorption peak in a wavelength range of 800–1100 nm, and a second infrared light absorbent (B) that has an absorption peak in a wavelength range of 1100–2000 nm.

BRIEF DESCRIPTION OF THE DRAWINGS

Other objects, features, and advantages of the present invention will become more apparent from the following detailed description when read in conjunction with the accompanying drawings, in which:

FIG. 1 is a diagram showing Table 1 summarizing evaluation results of an image fixing of two groups of toner sets; and FIG. 2 is a diagram showing Table 2 summarizing evaluation results of the image fixing of two groups of toner sets with three color-toners, excepting a block color.

DESCRIPTION OF THE PREFERRED EMBODIMENTS

In the following, embodiments of the image formation method of the present invention are described in detail. The image formation method of the present invention uses a plurality of color toners that contain at least a binder resin, a colorant, and an infrared light absorbent. Each of the color toners is laminated one-by-one on a recording medium, such as paper, and a toner powder image is generated. Each layer of the color toners is called a first layer, a second layer, and so on until the n-th layer, the first layer being immediately above the recording medium, and the last layer, i.e., the n-th layer, being the closest to a luminous source. Flashlight irradiation is applied to the laminated toner powder image such that the toner powder image is fused and fixed. This is called "sequential developments and one-time fixing" in the present specification.

Here, the present invention is unique in that the sequence in laying the toners is specified based on a PAS strength value. The PAS strength value is defied as an integral value of an infrared PAS spectrum in the wavelength range of 800–2000 nm, the PAS spectrum being obtained through a PAS analyzing measurement.

The present invention, using the PAS strength value, specifies the sequence of laying the toners such that heat from the radiant energy is efficiently transmitted from upper layers to lower layers, based on the following criteria.

1) The PAS strength value of the toner that is laid the closest to the luminous source has the greatest PAS strength value of all the toners that form the laminated toner layer.

In terms of realizing an image formation apparatus, a development unit that is arranged so as to develop the toner of the top layer (the n-th layer) contains a toner, the PAS strength value of which is greater than the PAS strength value of any other toners that form other toner layers.

2) The PAS strength value of a first toner is set to be greater than the PAS strength value of a second toner that is laid immediately beneath the first toner.

In terms of realizing an image formation apparatus, a development unit that is arranged so as to develop a relatively upper layer contains a toner, the PAS strength value of which is greater than the PAS strength value of a toner contained in another development unit arranged so as to develop a relatively lower layer.

Requirements described above can be easily provided in image formation apparatuses such as a copying machine, a printer, and a facsimile machine.

In addition, the present invention can be applied to any development process that uses a toner, such as electrophotography, iono-graphy, and magneto-graphy.

Typical image formation apparatuses that use the "sequential developments and one-time fixing" method include a tandem type full color electronic photograph printer. This kind of printer generally carries out development for 4 times such that a toner powder image of maximum 4 toner layers is formed on the recording medium, and the toner powder image is fixed in one shot.

According to a manuscript (original image), the number of the toners layered differs from point to point on the recording medium from a single toner layer to a four-toner layer. The four toners are named $\alpha$, $\beta$, $\gamma$, and $\delta$ for convenience.

Specifically, there will be layer patterns such as single layer patterns of $\alpha$, $\beta$, $\gamma$, and $\delta$; two layer patterns of $\alpha+\beta$, $\alpha+\gamma$, $\alpha+\delta$, $\beta+\gamma$, $\beta+\delta$, and $\gamma+\delta$, three layer patterns of $\alpha+\beta+\gamma$, $\alpha+\beta+\delta$, $\alpha+\gamma+\delta$, and $\beta+\gamma+\delta$ and a four layer pattern of $\alpha+\beta+\gamma+\delta$. Fixing all these patterns satisfactorily and simultaneously is required.

Furthermore, in order to exhibit gray scale, the amount of development of each color changes from zero to a maximum development amount allowed in the development process.

Thus, fixing a toner powder image consisting of the different toners in different amounts from point to point of the image by one shot of the flashlight is not an easy task. This is due to the fact that relatively high radiant energy does not necessarily provide a satisfactory fixing result where there are multiple layers, and where development amounts of toner are large, even though fixing of a toner powder image of a thin single toner layer is easy at a relatively low optical energy.

The inventors of the present invention et al. have determined the cause of the unsatisfactory fixing described above is not only that the total amount of the toners to be fused is large, but that irradiated optical energy is absorbed by upper layers, and lower layers receive an attenuated amount of the energy, resulting in poor fusion at the lower layers.

Accordingly, the object of the present invention is to obtain a satisfactory fixing of a laminated toner layer that consists of varied layer structures with as little energy as possible. The objective is realized by arranging a toner that has a relatively high radiant energy absorption efficiency, and radiant-thermal energy conversion efficiency on the top of the layers. In this manner, heat is transmitted to toners in lower layers, resulting in a satisfactory fixing of all the toner layers with a relatively small amount of irradiated energy.

Color toners that are used in the present invention are desired to have a PAS strength value that ranges between 0.01 and 0.2, where the PAS strength value is an integral value of an infrared PAS spectrum of the concerned color toner in a wavelength range between 800 nm and 2000 nm, and the PAS strength value of carbon black is set to 1.

There are cases where a black toner and color toners are simultaneously fixed by a fixing unit of the image formation apparatus, when forming a color image. In these cases, the PAS strength value of each of the color toners is set between 0.2 and 0.9 times the PAS strength value of the black toner such that the black toner and the color toners are efficiently fixed with a lower radiant energy.

In addition, where a first color toner (for example, red), and a second color toner (for example, blue) are simultaneously fixed, it is desirable to set the PAS strength value of the second toner between 0.2 and 5 times the PAS strength value of the first color toner. By setting the color toners in this manner, an efficient flashlight fixing of the color toners is obtained with a reduced radiant energy.

The color toners used in the present invention can be manufactured according to a conventional manufacturing process. At least, a binder resin, a colorant, and an infrared light absorbent that has radiant energy absorption capability in the wavelength range of 800–2000 nm are prepared. Further, an electrification control agent and wax are added if desired. These combined materials constitute a raw material. The raw material is kneaded by, e.g., a pressurizing kneader, a rolling mill, an extrusion machine, etc., such that the materials are mixed uniformly. Then, for example, a grinder, a jet mill, etc., is used to grind and fine-grind the raw material. Then, a wind classifier, e.g., is used to separate color toner powder in a desired range of granule dimensions.

Here, as for the kneading, the infrared light absorbent may be kneaded with a resin separately from the electrification control agent that is independently kneaded with a resin, and the two kneaded materials are then kneaded, as disclosed by, e.g., JP H07-191492A.

An infrared light absorbent that can be used by the color toner includes a naphthalo cyanine system compound, an aminium system compound, a dimonium system compound, a poly methine system compound, a cyanine system compound, an anthraquinone system compound, a phthalocyanine system compound, a dithiol-nickel complex, a metal complex compound of azo cobalt complex, a squarilium system compound, tin oxide, and lanthanoid such as ytterbium oxide, and ytterbium phosphate.

It is desirable that two or more kinds of the infrared light absorbents are used. It is especially desirable that an infrared light absorbent that has an absorption peak in the wavelength range of 800 nm–1100 nm, and an infrared light absorbent that has an absorption peak in the wavelength range of 1100 nm–2000 nm are used.

As for an amount of the infrared absorbent to be added to the color toner, it is desirable that the amount ranges 0.1–10% in weight, more preferably 0.1–3% in weight. The amount of addition here is a total amount of addition of a plurality of the infrared light absorbents applied together.

As the binder resin contained in the color toner, a conventional thermoplastic resin can be used. For example, an epoxy resin, a styrene acrylic resin, a polyamide resin, a polyester resin, a poly vinyl resin, a polyurethane resin, a poly butadiene resin, and the like that have the glass transition temperature between 40 and 80 degrees C., and a softening point between 80 and 140 degrees C., either singly or mixed. If desired, a wax (for example, carnauba, montan, polyethylene, amide, ester, polypropylene, etc.) can be added to the binder resin.

As for the colorant that the color toners can contain, there is no special limitation, and publicly well-known colorants can be used. For example, mono azo system red paints, disazo system yellow paints, quinacridone system magenta paints, anthraquinone dye, nigrosine system dye, a quaternary ammonium salt, and a metal complex salt dye of a mono azo system can be used. These colorants may be used singly or mixed, as required.

The specific colorants as follows can be used, namely, aniline blue (C.I. No. 50405), calco oil blue (C I. No. azoic blue 3), chrome yellow (C.I. No. 14090), ultra marine blue (C.I. No. 77103), du Pont oil red (C.I. No. 26105), quinoline yellow (C.I. No. 47005), methylene blue chloride (C.I. No. 52015), phthalocyanine blue (C.I. No. 74160), malachite green oxalate (C.I. No. 42000), edible red No.2 (amaranth, C.I. No. 16185), edible red No.3 (erythrocin, C.I. No. 45430), edible red No.40 (alula red AC, C.I. No. 16035), edible red No.102 (new coccine, C.I. No. 16255), edible red No.104 (floxine, C.I. No. 45410), edible red No.105 (rose Bengal, C.I. No. 45440), edible red No.106 (acid red, C.I. No. 45100), edible yellow No.4 (tartradin, C.I. No. 19140), edible yellow No.5 (sunset yellow FCF, C.I. No. 15985), edible green No.3 (first green FCF, C.I. No. 42053), edible blue No.1 (brilliant blue FCF, C.I. No. 42090), edible blue No.2 (indigo carmine, C.I. No. 73015), and the like.

It is desirable that a color toner contains colorants such as above between 0.1 and 20% in weight, more preferably, between 0.5 and 10% in weight.

In summary, it is recommended that the color toner contains a binder resin 75–95% in weight, colorants totaling 0.1–20%, more preferably 0.5–10%, in weight, and infrared light absorbents totaling 0.1–10%, more preferably 0.1–3%, in weight.

Furthermore, to this color toner, an electrification control agent may be added such that electrification properties are attached, and variations in electrification amount due to variations of temperature and humidity are reduced. It is recommended that the electrification control agent be colorless or hypo chromic.

As the electrification control agent, publicly well-known positive electrification and negative electrification products may be used, such as the quaternary ammonium salt compound, a salicylic acid compound, a fluoboric acid system complex, a calbonic acid system compound, and the like.

Furthermore, in order to raise the fluidity of the color toner, inorganic granules (called external additive, hereinafter) may be applied to the toner surface. The dimension of the granules of the external additive that can be used here is 2 nm–500 nm in diameter, more preferably, 5 nm–200 nm. Further, it is desired that the specific surface area measured by the BET method ranges between 20 $m^2/g$ and 500 $m^2/g$.

It is desirable that the ratio of the external additive mixed to the color toner is 0.1–5%, more preferably 0.1–2.0%, in weight. The following materials can be used as the external additive, namely, granules of silica, alumina, titanium oxide, titanium acid barium, titanium acid magnesium, titanium acid calcium, titanium acid strontium, a zinc oxide, silica sand, clay, mica, wollastonite, diatomite, chromium oxide, cerium oxide, red ocher, antimony trioxide, magnesium oxide, zirconium oxide, sulfuric acid barium, carbonic acid barium, calcium carbonate, carbonic acid silicon, silicon nitride, and the like. Among the materials listed above, it is desirable to use the silica granules. In addition, as for the external additive, it is more desirable to use a material the surface of which has been hydrophobically processed.

Hereinafter, the image formation based on the present invention is more specifically explained by showing an embodiment.

In order to clarify the relations among the image formation characteristics, the toner characteristics, a layer arrangement thereof, and radiant energy conditions of a fixing unit, the following toners and image formation apparatus were used.

As for a development process, a toner powder (laminating) image containing all image formation patterns corresponding to a manuscript was output on a recording medium using a tandem type full color printer (F6908B made by Fujitsu) from which a fixing unit part was removed.

As for a fixing process, flashing light was irradiated to the toner powder image on the recording medium such that the one-time fixing was carried out, where a laser printer (PS6908B made by Fujitsu) that employed the flashlight fixing method was used, and quality of fixing was evaluated.

As for the toners used in the evaluation, two kinds each of yellow (Y) toners, magenta (M) toners, and cyan (C) toners were prepared, one of the two kinds of each color being with a relatively greater PAS strength and the other of the two kinds of each color being with a relatively lower PAS strength, and further, one black (K) toner was prepared. The toners were chosen and combined in a variety of combinations, when forming the image.

Here, adjustment of the PAS strength value of the toners was performed by changing the amount of the infrared light absorbent added to the toner.

Moreover, the toners satisfied the desirable relations of the PAS strength values mentioned above. That is, the PAS strength values of the yellow (Y) toners, magenta (M) toners, and cyan (C) toners were within the limits of 0.01–0.2, when the PAS strength value of carbon black was set to 1. Moreover, each of the values was set up to 0.2 to 0.9 times the PAS strength value of the black (K) toner, and was set up within the limits of 0.2 to 5 times mutually.

In the following, manufacturing prescriptions of the toners are described. Here, a percentage "%" represents a percentage in weight.

(Manufacturing Prescription of Toner "a")

Cyan Toner

Binder resin: Polyester resin (FN-13; Kao make) 92%

Infrared light absorbent (A): Naphthalocyanine compound (YKR-5010; Yamamoto Chemicals, Inc. make) 0.3% Infrared light absorbent (B): Ytterbium oxide (UU-HP type; Shin-etsu Chemistry Company make) 1% Copper phthalocyanine paints (Lionol Blue ES; Toyo Ink Mfg. Co., Ltd. make) 5%

Negative electrification control agent: E-89 (Orient Chemistry Company make) 1%.

The above materials were put into a Henschel mixer, and a preparatory kneading was carried out. Then, an extruder was used for kneading. Then, a hammer mill performed rough grinding. Then, a jet mill carried out fine grinding. Then, an airflow classifier was employed to obtain the cyan color toner granules of an average of about 8.5 $\mu$m in diameter.

Subsequently, hydrophobic silica granule (H2000/4; Clariant make) was added in an amount equal to 0.5%, as an external additive. The Henschel mixer was employed to perform the external additive attaching process, and the cyan color toner "a" was obtained.

A PAS strength value of the cyan color toner obtained as above was measured. The procedure of measurement is as follows.

The cyan toner "a" was taken to a stainless steel plate that was set to a PAS measuring instrument (Photo acoustic Model 300; made by MTEC). Then, the atmosphere (air) was replaced by helium gas under the conditions of 10 ml/s and 10 s. Then, measurement was performed using FT-IR (made by Mattson). An infrared PAS spectrum was obtained with the number of times of integration set to 200 times, and the infrared.PAS spectrum was integrated in the wavelength range of 800–2000 nm to obtain the PAS strength value. As the standard for the PAS strength value, the PAS strength value of carbon black was employed, which was normalized at 1. The PAS strength values of the toners are expressed in relative values to the standard value. Specifically, the measurement result of the cyan toner was 0.05.

Similarly, a total of six kinds of toner, namely, two kinds of yellow, one more kind of cyan, two kinds of magenta, and one sort of black were manufactured further, and the PAS strength value of each of the toners was measured. In the following, each toner's prescription and measured PAS strength value are described.

(Manufacturing Prescription of Toner "b")

Cyan Toner

Binder resin: Polyester resin (FN-13; Kao make) 92%

Infrared light absorbent (A): Naphthalocyanine compound (YKR-5010; Yamamoto Chemicals, Inc. make) 0.6%

Infrared light absorbent (B): Ytterbium oxide (UU-HP type; Shin-etsu Chemistry Company make) 1%

Colorant: Copper phthalocyanine paints (Lionol Blue ES; Toyo Ink Mfg. Co., Ltd. make) 5%

Negative electrification control agent: E-89 (Orient chemistry company make) 1%

PAS strength: 0.07

(Manufacturing Prescription of Toner "c")

Magenta Toner

Binder resin: Polyester resin (FN-13; Kao make) 92%

Infrared light absorbent (A): Naphthalocyanine compound (YKR-5010; Yamamoto Chemicals, INC. make) 0.3%

Infrared light absorbent (B): Ytterbium oxide (UU-HP type; Shin-etsu Chemistry Company make) 1%

Colorant: Quinacridone (E-02; Hoechst A.G. make) 5%

Negative electrification control agent: E-89 (Orient Chemistry Company make) 1%

PAS strength: 0.045

(Manufacturing Prescription of Toner "d")

Magenta Toner

Binder resin: Polyester resin (FN-13; Kao make) 92%

Infrared light absorbent (A): naphthalocyanine compound (YKR-5010; Yamamoto Chemicals, Inc. make) 0.6%

Infrared light absorbent (B): Ytterbium oxide (UU-HP type; Shin-etsu Chemistry Company make) 1%

Colorant: Quinacridone (E-02; Hoechst A.G. make) 5%

Negative electrification control agent: E-89 (Orient chemistry company make) 1%

PAS strength: 0.065

(Manufacturing Prescription of Toner "e")
Yellow Toner
Binder resin: Polyester resin (FN-13; Kao make) 92%
Infrared light Absorbent (A): Naphthalocyanine compound (YKR-5010; Yamamoto Chemicals, Inc. make) 0.3%
Infrared light absorbent (B): Ytterbium oxide (UU-HP type; Shin-etsu Chemistry Company make) 1%
Colorant: Benzimidazolone (P-HG; Hoechst A.G. make) 5%
Negative electrification control agent: E-89 (Orient Chemistry Company make) 1%
PAS strength: 0.04
(Manufacturing Prescription of Toner "f")
Yellow Toner
Binder resin: Polyester resin (FN-13; Kao make) 92%
Infrared light absorbent (A): Naphthalocyanine compound (YKR-5010; Yamamoto Chemicals, Inc. make) 0.6%
Infrared light absorbent (B): Ytterbium oxide (UU-HP type; Shin-etsu Chemistry Company make) 1%
Colorant: Benzimidazolone (P-HG; Hoechst A.G. make) 5%
Negative electrification control agent: E-89 (Orient Chemistry Company make) 1%
PAS strength: 0.06
(Manufacturing Prescription of Toner "g")
Black Toner
Binder resin: Polyester resin (FN-13; Kao make) 90%
Colorant: Carbon black (MA100S; Mitsubishi Chemical make) 8%
Negative electrification control agent: E-89 (Orient Chemistry Company make) 2%
PAS strength: 0.11

Next, each of the above yellow, magenta, cyan, and black toners was constituted into a 2-ingredient development agent, and the tandem type full color printer (F6908B made by Fujitsu) from which the fixing unit was removed was used in order to develop (to generate a powder image) of all image formation patterns corresponding to the manuscript (original image). At that time, the amount of each of the toners of the powder image on the recording medium was adjusted to a development process condition that each color powder was to be provided at a rate of 0.5 mg/cm$^2$.

As for the composition of the 2-ingredient development agent toner, a methyl methacrylate resin coating ferrite composition (Kanto Denka Kogyo Co., Ltd. make) was used, density of which was adjusted to be 5% in weight. In addition, an amount of magnet blow-off electrifications was 12–18 $\mu$C/g.

Then, the above operations were repeated with different sets of development sequence of the colors. That is, lamination sequence of the toners, namely, yellow, magenta, cyan, and black, was changed one after another, and the operations were repeated. The operations generated 24 kinds of laminated patterns as the toner powder images. At that occasion, adjustments were made such that weight and thickness of all the laminated patterns became uniform.

Then, flashing light was irradiated to the toner powder image on the recording medium to obtain the image fixed by the one-time flashing. For this purpose, a laser printer (PS2160 made by Fujitsu) that employed the flashlight fixing method was used. Then, quality of the fixing was evaluated.

In the above experiments, an amount of irradiation light energy that was required to fix the most difficult part of the laminated image was determined, the most difficult part being a part where the four layers of the toners, namely, yellow, magenta, cyan, and black toners are laminated, by increasing the irradiation energy from 2.8 J/cm$^2$ to 3.6 J/cm$^2$ in 0.1 J/cm$^2$ steps. Whether a fixing result was satisfactory was determined by a tape exfoliation examination, where an image density conservation ratio of 70% or higher was determined to be satisfactory.

The tape exfoliation examination was practiced as follows. An adhesion tape (Scott Mending tape; made by 3M) was lightly attached to the fixed image, and a pillar block was rolled in the direction of the circumference the pillar block on the tape with a linear pressure of 250 g/cm such that the adhesion tape was securely adhered to the image surface. Then, the adhesion tape was removed. Then, the optical density value after the adhesion tape was removed was compared with the optical density value before the adhesion tape was attached, such that a fixing ratio was obtained using the formula that follows.

The ratio (%) of fixing=(optical density after tape removed/optical density before tape attached)×100

The optical density was measured by a spectrum color measuring instrument (CM-3700d; made by Minolta Camera Co., Ltd.), measuring reflective light in the wavelength range of 400 nm–800 nm. A light absorption value that is the greatest within the wavelength range is adopted as the optical density value.

Table 1 shown in FIG. 1 summarizes evaluation results of the image fixing of two groups of toner sets, a first group consisting of the toners "a", "c", "e", and "g", and a second consisting of the toners "b", "e", "f", and "g". All sequential combinations were measured for each of the sets. Table 1 lists sequential combinations that presented a first satisfactory result as the radiant energy value was incremented as mentioned above. For example, KCMY indicates a sequential combination wherein the black toner K was put closest to the luminous source, then cyan C, then magenta M, and then, the yellow Y was put closest to the recording medium. Table 1 indicates, among other things, that the KCMY combination and 5 others in the second group presented a satisfactory result at 2.8 J/cm$^2$; the KCMY combination and 5 others in the first group presented a satisfactory result at 2.9 J/cm$^2$; and the YCMK and two other combinations required 3.6 J/cm$^2$.

The left-hand most represents the closest to the luminous source. The right-hand most represents the closest to the recording medium.

From Table 1, it was determined that toner arrangements where the toner "g" (that is K: black toner) having the greatest PAS strength value was arranged on the top required the lowest irradiation energy, while providing a satisfactory fusion (fixing) result in both groups.

In this relation, the inventors of the present invention et al. assume that the top toner layer absorbed the irradiated energy efficiently, carried out radiant energy-to-heat conversion efficiently, and the heat permeated through the lower toner layers, and therefore, all the toner layers were satisfactorily fused. That is, it is desirable to form a laminated toner layer by arranging a toner that has the largest PAS strength value on the top of the laminated layer, and usually, such a toner is a black toner.

Next, studies similar to above were made with the three color-toners, excepting the black toner. Relations between toner laminating sequence and irradiation energy were found as summarized in Table 2 shown in FIG. 2.

The left-hand most represents the closest to the luminous source. The right-hand most represents the closest to the recording medium.

From Table 2, it was determined that the layer structures, where the toner layers were arranged in the order of the magnitude of the PAS strength value, tended to be satisfactorily fixed at a lower irradiation energy. The order is such that the toner layer having the greatest PAS value is placed on the top, i.e., the closest to the luminous source, and the toner having the smallest PAS value is placed at the bottom of the layer, that is, the closest to the recording medium.

The inventors of the present invention et al. assume that if the toner having the greatest PAS strength value is placed the closest to the luminous source as in the structures described above, efficiency of radiant energy absorption by each of the layers becomes high, realizing satisfactory fixing of all the layers at a relatively low irradiation energy.

As described above, according to the present invention, laminated toners can be satisfactorily fixed with a low energy of irradiation, owing to the top layer, which has the greatest PAS strength value, absorbing the radiant energy most efficiently, and efficiently transmitting heat to the lower layers.

Further, the present invention is not limited to these embodiments, but various variations and modifications may be made without departing from the scope of the present invention.

The present application is based on Japanese priority application No.2002-097183 filed on Mar. 29, 2002, with the Japanese Patent Office, the entire contents of which are hereby incorporated by reference.

What is claimed is:

1. An image formation method that forms a color image by fixing a laminate structured by n units of toner layers, namely, a first layer to an n-th layer, the first layer being placed immediately above a recording medium, each toner layer different in color, in one shot of flashing light, the laminate being generated by developments for n times, each for a different color, wherein a PAS strength value of the n-th layer that is placed most closely to a flashing light source is greater than a PAS strength value of any other layer.

2. The image formation method as claimed in claim 1, wherein a PAS strength value $S_x$ of a toner that forms an x-th layer contained in the n units of the toner layers, and a PAS strength value $S_{x-1}$ of a toner that forms an (x−1)-th layer suffice a formula (1) that follows, where n=>x>1:

$$S_{x-1} <= S_x \quad (1).$$

3. The image formation method as claimed in claim 1, wherein a black toner serves as the n-th layer that is placed most closely to the flashing light source.

* * * * *